US008903301B2

(12) United States Patent
Hattori

(10) Patent No.: US 8,903,301 B2
(45) Date of Patent: Dec. 2, 2014

(54) IMAGE FORMING APPARATUS

(75) Inventor: Makoto Hattori, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 882 days.

(21) Appl. No.: 12/748,758

(22) Filed: Mar. 29, 2010

(65) Prior Publication Data

US 2010/0329763 A1 Dec. 30, 2010

(30) Foreign Application Priority Data

Jun. 24, 2009 (JP) ..... 2009-149607

(51) Int. Cl.
*B65H 11/00* (2006.01)
*G03G 15/00* (2006.01)
*B65H 5/26* (2006.01)

(52) U.S. Cl.
CPC ..... *B65H 5/26* (2013.01); *B65H 2402/46* (2013.01); *G03G 2215/00392* (2013.01); *G03G 15/6514* (2013.01); *B65H 2801/06* (2013.01); *B65H 2402/442* (2013.01); *B65H 2407/21* (2013.01)
USPC ..... 399/392; 399/391; 399/388

(58) Field of Classification Search
CPC ..... G03G 15/6514; G03G 2215/00392; B65H 2402/442; B65H 2407/21
USPC ..... 399/405, 391, 392, 388, 393, 381; 271/9.09
IPC ..... B65H 11/00
See application file for complete search history.

(56) References Cited

U.S. PATENT DOCUMENTS 5,526,104 A 6/1996 Kawano
6,547,288 B1 4/2003 Ito et al.
(Continued)

FOREIGN PATENT DOCUMENTS

JP 64-64932 3/1989
JP UM-H07-002345 A 1/1995
(Continued)

OTHER PUBLICATIONS

Office Action dated Aug. 2, 2011 received from the Japanese Patent Office from related Japanese Application No. 2009449607, together with an English-language translation.
(Continued)

*Primary Examiner* — Judy Nguyen
*Assistant Examiner* — Jennifer Simmons
(74) *Attorney, Agent, or Firm* — Scully, Scott, Murphy & Presser, PC

(57) ABSTRACT

An image forming apparatus including an image forming unit; a first conveying path, along which a recording medium accommodated in a paper feeding cassette is conveyed to the image forming unit; and a second conveying path, along which a recording medium inserted into a manual paper feeding port is conveyed to the image forming unit; wherein the manual paper feeding port is formed at a front side of the image forming apparatus on an upper surface of an apparatus main body and wherein an inclined path obliquely extending from the manual paper feeding port to below and toward a rear of the apparatus main body is also formed, wherein the second conveying path is structured so that a recording medium inserted into the manual paper feeding port can fall into the inclined path due to the weight of the recording medium.

9 Claims, 3 Drawing Sheets

(56) References Cited

U.S. PATENT DOCUMENTS

| | | | | |
|---|---|---|---|---|
| 7,252,446 | B2 * | 8/2007 | Katayama et al. | 400/613 |
| 2008/0240776 | A1 | 10/2008 | Ishikawa | |

FOREIGN PATENT DOCUMENTS

| | | | |
|---|---|---|---|
| JP | 7-81807 | | 3/1995 |
| JP | 7-266646 | | 10/1995 |
| JP | H08-240944 | A | 9/1996 |
| JP | H11-227992 | A | 8/1999 |
| JP | A-2008-242142 | | 10/2008 |

OTHER PUBLICATIONS

Japanese Office Action dated Nov. 29, 2011 from related Japanese Application No. 2009-149607, together with an English language translation.

Japanese Official Action dated Apr. 12, 2011 together with an English language translation from JP 2009-149607.

* cited by examiner

IMAGE FORMING APPARATUS

CROSS REFERENCE TO RELATED APPLICATION

The present application claims priority from Japanese Patent Application No. 2009-149607, which was filed on Jun. 24, 2009, the disclosure of which is incorporated herein by reference in its entirety.

BACKGROUND

The present invention relates to an image forming apparatus.

Conventionally, a printer equipped with a manual paper feeding port, separate from a paper feeding cassette which is built in an apparatus main body has been proposed. In this printer, the manual paper feeding port is disposed at the front (front surface) of the printer, under an operating panel on which various operating switches are disposed.

By use of the above-described manual paper feeding port, for example, where a user desires to record on a recording medium (for example, envelopes) different from a recording medium placed in a paper feeding cassette (for example, general print), a user feeds the desired recording media through the manual paper feeding port to the printer, to make the printer execute recording (image formation) on the desired recording medium (envelopes, for example).

In this case, a manual paper feeding port is disposed at the front side of a printer and a recording medium must be kept substantially horizontal when inserted into the manual paper feeding port. However, when a flexible medium is to be recorded on (for example, relatively thin paper or soft film), even if a user holds one edge side of the recording medium by hand to attempt to insert the other side edge thereof into the manual paper feeding port, the other edge side of the recording medium droops down due to the weight of the recording medium, and the recording medium cannot be held substantially horizontal.

Therefore, a user cannot properly insert the other end of the recording medium into the manual paper feeding port, wasting time and causing trouble when inserting the recording medium. Further, even if the user has inserted the other edge side of the recording medium into the manual paper feeding port, the recording medium may fall from the manual paper feeding port when the user releases the edge side in the user's hand.

Further, where a printer is disposed at a lower position relative to the user, a user has to look down at the printer from an angle at a higher position relative to the printer. However, it is difficult to insert the recording medium into the manual paper feeding port in a substantially horizontal direction only by stretching his/her hand from the higher position. Thus, the user must position him or her self low to insert the recording medium.

SUMMARY

Exemplary embodiments of the present invention have been made in order to address the above problem, and an object of these exemplary embodiments is to provide an image forming apparatus in which the recording medium can be inserted into a manual paper feeding port more easily.

In order to achieve the object, the exemplary embodiment of the present invention provides an image forming apparatus comprising:

an image forming unit which forms an image on a recording medium;

a first conveying path, along which a recording medium accommodated in a paper feeding cassette is conveyed to the image forming unit from the paper feeding cassette; and a second conveying path, along which a recording medium inserted into a manual paper feeding port is conveyed to the image forming unit from the manual paper feeding port;

wherein the manual paper feeding port is formed at a front side of the image forming apparatus on an upper surface of an apparatus main body, wherein an inclined path obliquely extending from the manual paper feeding port to below and toward a rear of the apparatus main body is formed, and wherein the second conveying path is structured so that a recording medium inserted into the manual paper feeding port can fall into the inclined path due to the weight of the recording medium.

DETAILED DESCRIPTION OF EXEMPLARY EMBODIMENTS

Now a description will be given for an embodiment of the present invention with appropriate reference to the accompanying drawings.

Structure of the Image Forming Apparatus

Figure 1:
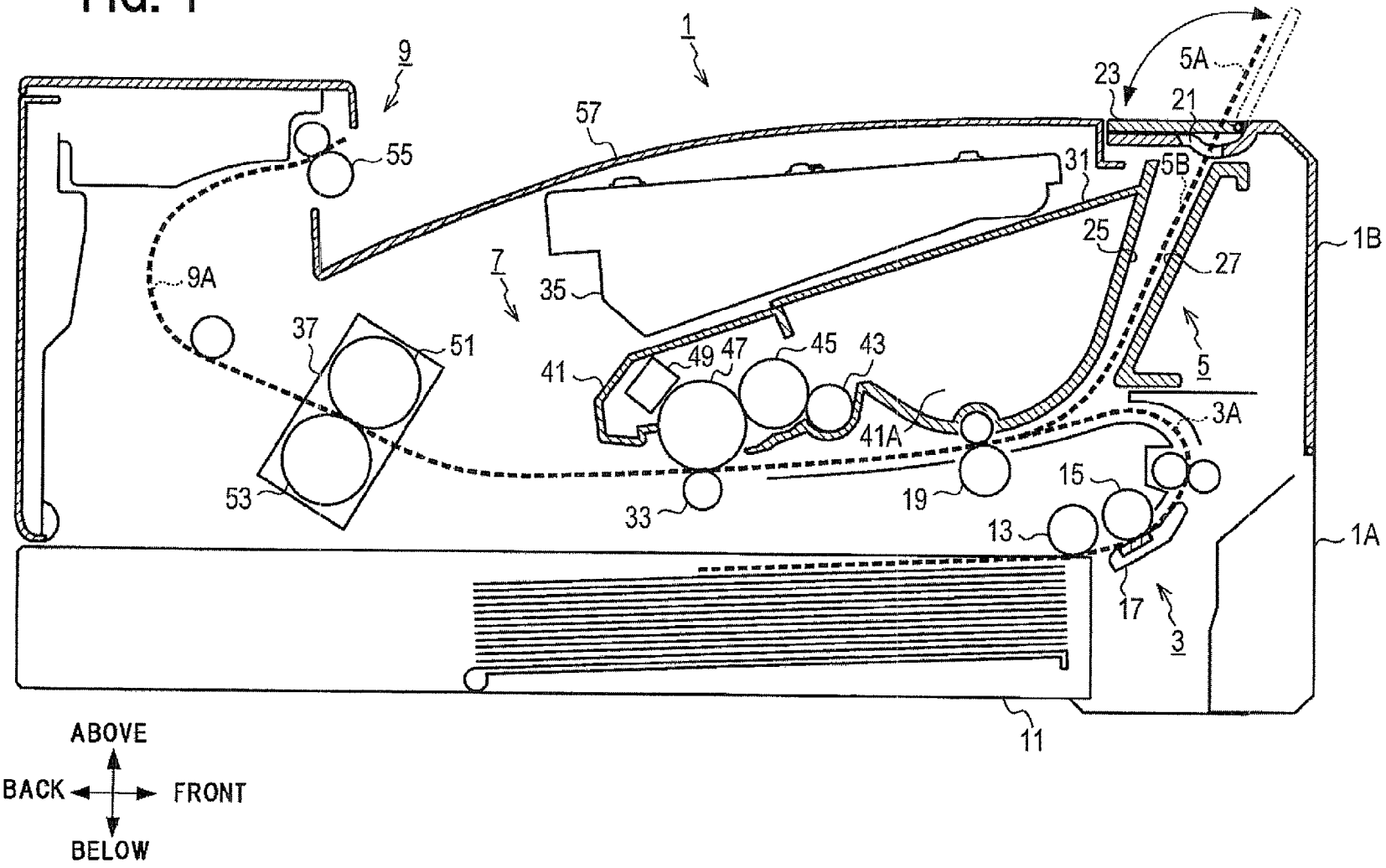
FIG. 1 is a vertical cross sectional view of an inner structure of an image forming apparatus when viewed from the left side surface.

As shown in FIG. 1, the image forming apparatus 1 of the present embodiment is an apparatus for forming an image on a recording medium using an electro-photographic method and provided with a first paper feeding unit 3, a second paper feeding unit 5, an image forming unit 7, and a paper discharging unit 9, etc.

Among these units, the first paper feeding unit 3 is provided with a first conveying path 3A along which a recording medium accommodated in a paper feeding cassette 11 is conveyed from the paper feeding cassette 11 to the image forming unit 7. More specifically, the first conveying path 3A is a path along which the recording medium is conveyed from the paper feeding cassette 11 to the front side of an apparatus main body 1A. The conveying path 3*a* then bends toward the back of the apparatus main body 1A, and reaches the image forming unit 7.

In order to form the above-described first conveying path 3A, a pick-up roller 13, a separation roller 15, a separation pad 17, and a registration roller 19, etc. are disposed in the first paper feeding unit 3. In the first paper feeding unit 3, the recording medium is accommodated inside the paper feeding cassette 11 and the recording medium is taken out of the paper feeding cassette 11 by the pick-up roller 13, which is located inside the apparatus main body 1A. Further, the recording medium is fed to the front side of the apparatus main body 1A along the first conveying path 3A.

Then, the recording medium, which is fed by the pick-up roller 13, may be fed in a state that a plurality of recording media overlap each other. In order to eliminate the overlapped state, they are separated one by one by the separation roller 15 and the separation pad 17. The recording media which have passed through the separation roller 15 and the separation pad 17 bend toward the back of the apparatus main body 1A along the first conveying path 3A and are conveyed to the registration roller 19.

The registration roller 19 is a roller used for positioning the leading end of a recording medium and the registration roller 19 is disposed at a position in front of the point at which the recording medium reaches the image forming unit 7. When the recording medium reaches the registration roller 19, the recording medium is brought into contact with the registration roller 19 so that a print starting position on the recording medium is optimized. Further, in accordance with the print start positioning, the recording medium is corrected for skewing in a conveying direction, thereby preventing the recording medium from passing through the printer obliquely. Then, when the registration roller 19 is driven, the recording medium is conveyed to the image forming unit 7 along the first conveying path 3A.

Conversely, the second paper feeding unit 5 is provided with a second conveying path 5A along which the recording medium inserted into the manual paper feeding port 21 is conveyed from the manual paper feeding port 21 to the image forming unit 7. More specifically, in the second paper feeding unit 5, the manual paper feeding port 21 is formed at the front side on the upper surface of the apparatus main body 1A, and has an inclined path 5B, which obliquely extends from the manual paper feeding port 21 to below and toward the rear of the apparatus main body 1A.

The thus described inclined path 5B is formed and the second paper feeding unit 5 is structured so that the recording medium can be inserted into the manual paper feeding port 21 and can fall into the inclined path 5B due to the weight of the recording medium.

Further, the inclined path 5B merges with the first conveying path 3A on the upstream side, in a conveying direction of the recording medium, of the registration roller 19 to form a path leading to the image forming unit 7 from the manual paper feeding port 21.

In other words, the second conveying path 5A joins the first conveying path 3A and then continues toward the registration roller 19. On the downstream side, in a conveying direction of the recording medium, of the joining point, the same conveying path is commonly used in both the first conveying path 3A and the second conveying path 5A.

In order to form the above-described second conveying path 5A, the second paper feeding unit 5 is provided with a lid 23, a first guide unit 25, and a second guide unit 27, etc. The lid 23 is structured so as to be opened and closed, and when closed, the lid 23 covers the manual paper feeding port 21.

Figure 2A:
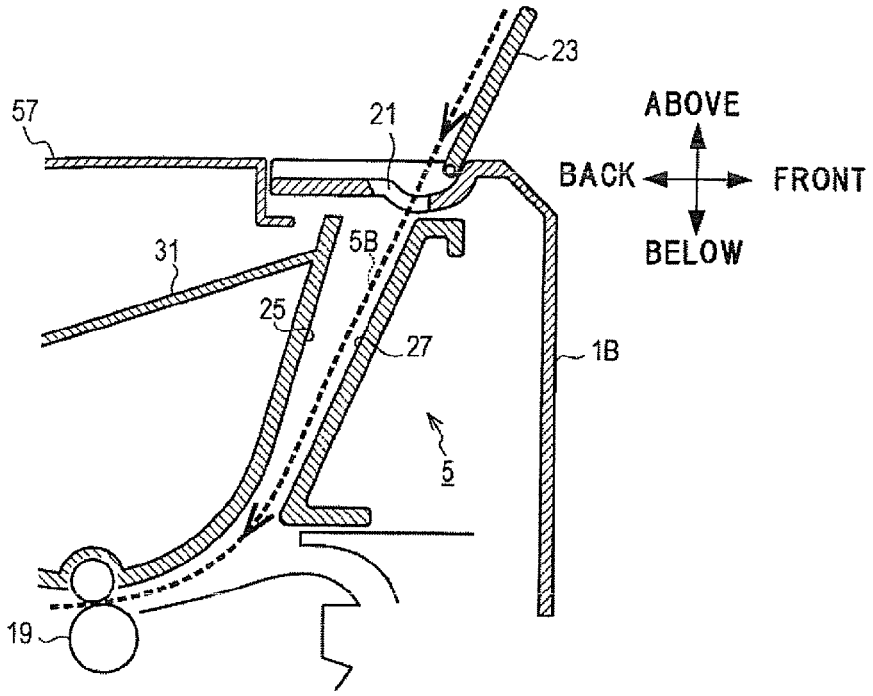
FIG. 2A is a view for explaining a state when the recording medium is supplied from a manual paper feeding port.

On the other hand, when the lid 23 is opened, as shown in FIG. 2A, the lid 23 acts as a supporter for supporting, from the back, the recording medium inserted into the manual paper feeding port 21, thereby keeping the recording medium inclined above the inclined path 5B. The first guide unit 25 and the second guide unit 27 are positioned so that a clearance is formed between them, and the clearance forms the above-described inclined path 5B.

In the above-structured second paper feeding unit 5, when the recording medium is inserted into the manual paper feeding port 21, the leading end of the recording medium can reach the registration roller 19. Therefore, when the recording medium is fed from the second paper feeding unit 5, the recording medium is brought into contact with the registration roller 19, by which a print starting position on the recording medium can be optimized and the recording medium can also be corrected for the inclination with respect to a conveying direction. Then, with the medium maintained in this state, the registration roller 19 is driven and the recording medium is conveyed to the image forming unit 7 along the second conveying path 5A.

The image forming unit 7 can form an image on the recording medium and is provided with a process cartridge 31, a transfer roller 33, an exposure meter 35, and a fixing vessel 37, etc. The process cartridge 31 is structured so that a feeding roller 43, a developing roller 45, a photosensitive member 47, and a charger 49, etc. are built in a case 41.

The process cartridge 31 is structured so as to be detachably attachable to the apparatus main body 1A. When the process cartridge 31 is loaded into the apparatus main body 1A, an outer surface part of the case 41 is used as the above-described first guide unit 25.

Figure 3:
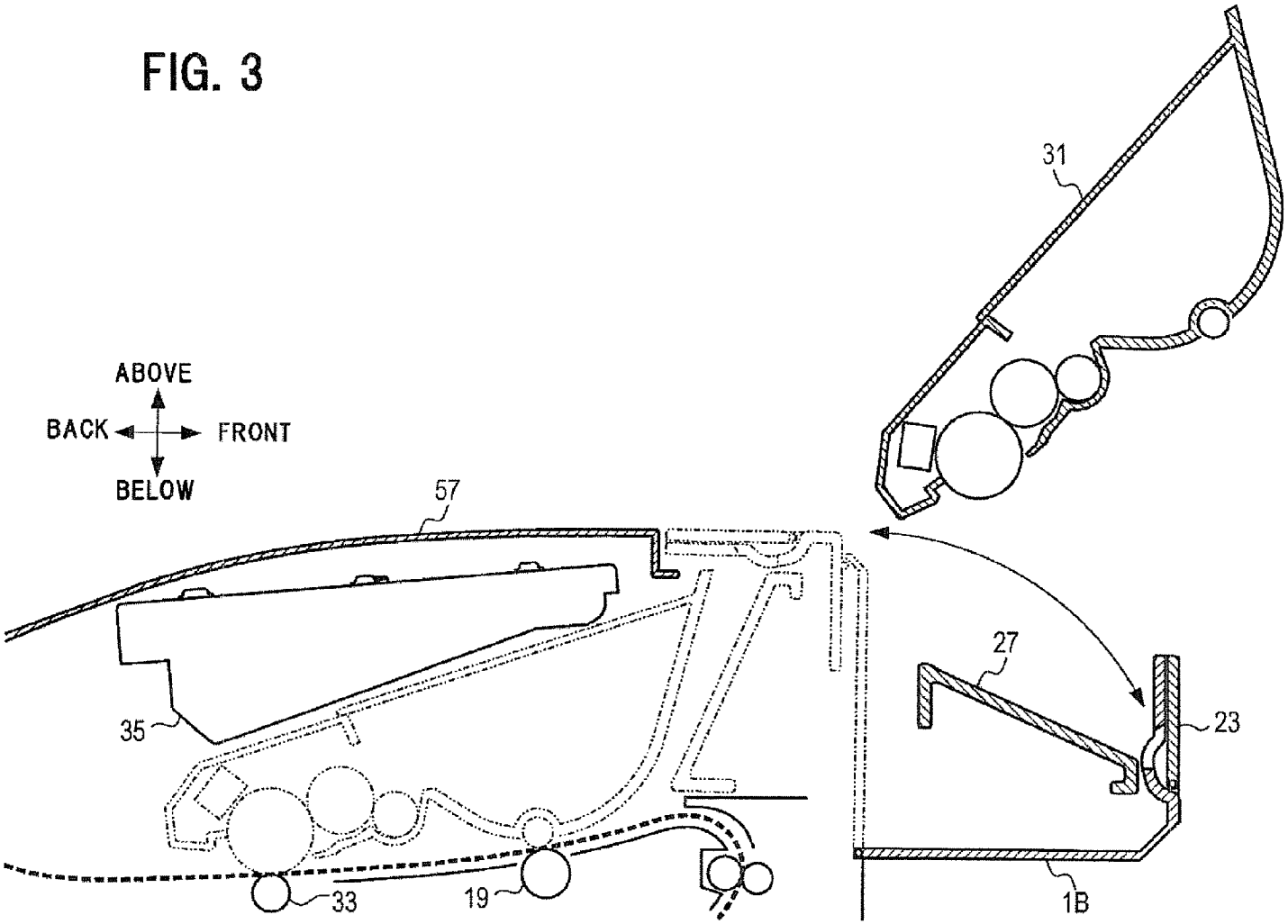
FIG. 3 is a view showing a state when a front cover opened to take out a developing cartridge.

Further, on the front surface of the apparatus main body 1A, as shown in FIG. 3, a front cover 1B, which can be opened and closed, is disposed. When the front cover 1B is opened, the process cartridge 31 can be detachably attachable to the apparatus main body 1A. Still further, when the front cover 1B is closed, an inner surface part of the front cover 1B is used as the second guide unit 27.

In the above-structured image forming unit 7, when an image is formed on the recording medium, the surface of the photosensitive member 47 is electrically charged by the charger 49 and the surface of the photosensitive member 47 is scanned by the exposure meter 35, thereby forming an electrostatic latent image on the photosensitive member 47.

Further, toner inside a toner accommodating chamber 41A is supplied to the developing roller 45 by the feeding roller 43, and an electrostatic latent image is developed on the photosensitive member 47 with the toner carried on the developing roller 45.

Then, while the recording medium is held between the photosensitive member 47 and the transfer roller 33, the photosensitive member 47 and the transfer roller 33 are rotated, by which a toner image carried on the photosensitive member 47 is transferred on the recording medium. The recording medium to which the toner image has been transferred is conveyed to the fixing vessel 37.

The fixing vessel 37 is provided with a heating roller 51 and a press roller 53. A heat source, such as a halogen lamp, is incorporated into the heating roller 51 and the recording medium held between the heating roller 51 and the press roller 53 and the medium is heated by heat from the heating roller 51. Thereby, a toner image carried on the recording medium is fixed on the recording medium. Then, the recording medium is fed to the paper discharging unit 9 in accordance with rotation of the heating roller 51 and the press roller 53.

The paper discharging unit 9 is provided with a discharging path 9A, which is used to conveying the recording medium having an image formed thereon by the image forming unit 7, from the image forming unit 7 to the upper surface of the apparatus main body 1A.

In order to configure the above-described discharging path 9A, the paper discharging unit 9 is provided with a paper discharging roller 55, etc. The recording medium, which is conveyed from the fixing vessel 37 to the back of the apparatus main body 1A, bends toward the front side of the apparatus main body 1A along the discharging path 9A and reaches the paper discharging roller 55.

Then, the recording medium is discharged from the paper discharging roller 55 toward the front side of the apparatus main body 1A. On the upper surface of the apparatus main body 1A, a paper discharging tray 57 is disposed, and the recording medium discharged outside the apparatus is piled up on the paper discharging tray 57.

Figure 2B:
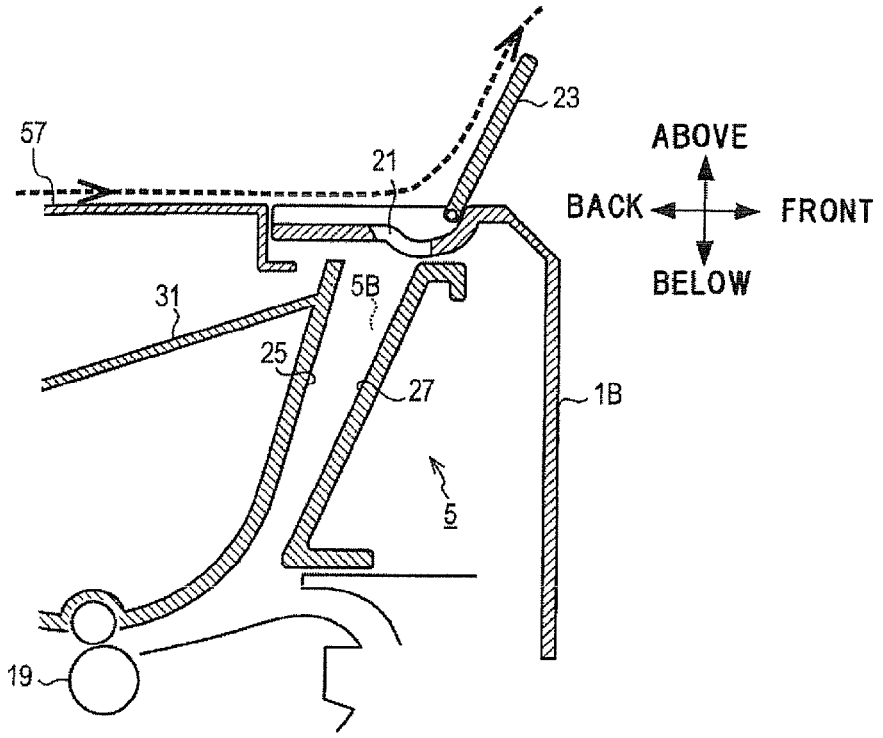
FIG. 2B is a view for explaining a state when the recording medium is discharged to a paper discharging tray.

The above-described manual paper feeding port 21 and the lid 23 are disposed at a position on the upper surface of the apparatus main body 1A further forward from the paper discharging tray 57. Therefore, where the recording medium, which has been discharged and piled up on the paper discharging tray 57, or has been newly discharged from the discharging path 9A, reaches a certain position of the lid 23, the lid 23 is kept open, as shown in FIG. 2B. Thus, the lid 23 acts as an obstacle for preventing or suppressing the recording medium, which has reached a certain position of the lid 23, from being pushed further toward the front side of the apparatus main body 1A.

As described above, according to the above discussed embodiment of the image forming apparatus 1, the inclined path 5B obliquely extends from the manual paper feeding port 21 to below and toward the back of the apparatus main body 1A, and the recording medium, which has been inserted into the manual paper feeding port 21 can fall into the inclined path 5B due to the weight of the recording medium.

Therefore, as compared with an image forming apparatus into which the recording medium is inserted substantially horizontal from a manual paper feeding port formed on the front surface of the apparatus, the recording medium inserted into the manual paper feeding port 21 is less likely to fall out of the manual paper feeding port 21, thus making it possible to smoothly conduct manual insertion of the medium.

Further, the manual paper feeding port 21 is formed at the front side on the upper surface of the apparatus main body 1A. Thereby, as compared with an image forming apparatus having a manual paper feeding port formed on the front surface of the apparatus, a user can easily approach the manual paper feeding port 21 from above. Therefore, the user can easily insert the recording medium targeting the manual paper feeding port 21 and also conduct manual insertion easily even when the image forming apparatus 1 is placed at a lower position relative to the user.

Further, according to the exemplary embodiment of the image forming apparatus 1, since the first guide unit 25 uses an outer surface part of the process cartridge 31, a dedicated guide part separate from the process cartridge 31 does not need to be disposed and the number of components can be reduced.

Further, at the time of replacing the process cartridge 31, the first guide unit 25 can also be replaced. Thus, even when the image forming apparatus 1 is used for a long time, every time the process cartridge 31 is replaced, the first guide unit 25 can also be replaced with a clean one. Therefore, it is possible to avoid damage to the recording medium resulting from damage to the first guide unit 25.

Further, according to the exemplary embodiment of the image forming apparatus 1, the second guide unit 27 is configured by using an inner surface part of the front cover 1B, and when the front cover 1B is opened, the inclined path 5B is also kept open. Thus, it is possible to easily remove paper when paper jams occur inside the inclined path 5B and clean the inside of the inclined path 5B.

Further, according to the exemplary embodiment of the image forming apparatus 1, the registration roller 19 can be commonly used by both the first conveying path 3A and the second conveying path 5A. Therefore, as compared with a registration roller disposed for each of the conveying paths, it is possible to reduce the number of components and also lower the manufacturing cost of the image forming apparatus 1.

Further, according to the exemplary embodiment of the image forming apparatus 1, the paper discharging tray is placed on the upper surface of the apparatus main body 1A. Therefore, unlike an apparatus which has a paper discharging tray, which projects from the back of the apparatus main body, the apparatus main body 1A can have a compact configuration to reduce the space necessary for installation of the image forming apparatus 1.

Further, a user can easily approach not only the manual paper feeding port 21 but also the paper discharging tray 57 from above. Thereby, even when the image forming apparatus 1 is placed in a lower position relative to the user, the user can easily insert the recording medium by hand and recover the recording medium which has been discharged.

Further, according to the exemplary embodiment of the image forming apparatus 1, when the manual paper feeding port 21 is not used, the lid 23 is closed, thereby making it possible to prevent foreign matter from entering the manual paper feeding port 21 or for noise generated from the image forming unit 7 to leaking outside the image forming apparatus 1.

Further, when the manual paper feeding port 21 is in use, the lid 23 is opened and the lid 23 can act a support for supporting the recording medium. Therefore, the recording medium is guided by the lid 23 to smoothly enter into the inclined path 5B. Thus, as compared with a case where the recording medium is not guided by the lid 23, the recording medium is prevented from passing through obliquely.

Still further, according to the exemplary embodiment of the image forming apparatus 1, where a long medium is to be recorded on, or a recording medium which has been discharged and piled up on the paper discharging tray is pushed to the front side of the image forming apparatus 1 by recording media newly discharged from the discharging path, the lid 23 is kept open and acts as an obstacle. Therefore, it is possible to prevent or suppress the recording medium from being pushed further toward the front side of the image forming apparatus 1 by using the lid 23 to prevent or suppress the recording medium from falling.

Additionally, where the recording medium rides over an obstacle preventing or suppressing the recording medium from being pushed further toward the front side of the image forming apparatus 1, a user can easily hold the end of the recording medium, thereby facilitating recovery of the recording medium from the paper discharging tray 57.

Modified Example

Above a description has been given of the embodiment of the present invention. However, the invention is not limited to the above specific embodiment and may be embodied in various modifications.

For example, in the above embodiment, a lid 23 covering the manual paper feeding port 21 is shown. Whether the lid 23 is provided or not is optional, and for example, where a lower-priced image forming apparatus is desired to be configured, the apparatus may be structured without a lid.

Further, in the above embodiment, the first conveying path 3A and the second conveying path 5A are made to join together in midstream so that both the conveying paths are configured to commonly use the registration roller 19. However, the first conveying path 3A and the second conveying path 5A may alternatively be configured so as to have their own respective exclusive registration rollers.

Still further, in the above embodiment, an inner surface part of the front cover 1B is used as the second guide unit 27. However, the front cover 1B and the second guide unit 27 may be configured as separate units.

In the above embodiment, an outer surface part of the process cartridge 31 is used as the first guide unit 25. However, the process cartridge 31 and the first guide unit 25 may be configured as separate units.

In addition, in the above embodiment, an image forming apparatus 1, which forms an image on the recording medium using an electro-photographic method, is exemplified. However, the present invention can be adopted for an image forming apparatus for forming an image by other methods (for example, an ink-jet method).

What is claimed is:

1. An image forming apparatus comprising:

an apparatus main body;

an image forming unit configured to form an image on a recording medium;

a first conveying path, along which a recording medium accommodated in a paper feeding cassette is conveyed to the image forming unit from the paper feeding cassette;

a second conveying path, along which a recording medium inserted into a manual paper feeding port is conveyed to the image forming unit from the manual paper feeding port; and a front cover configured to be opened and closed, and be disposed on a front surface of the apparatus main body, wherein when the front cover is opened, a cartridge into which at least a part of the image forming unit is incorporated can be detachably attachable to the apparatus main body;

wherein the manual paper feeding port is formed at a front side of the image forming apparatus on an upper surface of the apparatus main body and disposed above the cartridge attached to the apparatus main body, wherein an inclined path obliquely extending from the manual paper feeding port to below and toward a rear of the apparatus main body is formed, wherein a first guide portion and a second guide portion are disposed inside the apparatus main body, a clearance formed between the first guide portion and the second guide portion forms the inclined path, when the cartridge is loaded on the apparatus main body, an outer surface part of the cartridge forms the first guide portion, and when the front cover is closed, an inner surface part of the front cover forms the second guide portion, the image forming apparatus comprises a cover configured to be opened and closed, the cover being provided with the second guide portion and being movable together with the second guide portion.

2. The image forming apparatus according to claim 1, wherein the first conveying path is a path along which the recording medium is conveyed from the paper feeding cassette to the front side of an apparatus main body, the first conveying path bends toward the rear of the apparatus main body, and reaches the image forming unit, a registration roller, which positions the leading end of the recording medium, is disposed at a position in front of a position at which the recording medium reaches the image forming unit, and the second conveying path and the first conveying path merge together at the registration roller.

3. The image forming apparatus according to claim 1 further comprising: a discharging path from the image forming unit to the upper surface of the apparatus main body, wherein the recording medium is conveyed along the discharging path after the image is formed on the recording medium by the image forming unit; and a paper discharging tray which is disposed on the upper surface of the apparatus main body, wherein the recording medium conveyed through the discharging path is discharged and piled up on the paper discharging tray; wherein the manual paper feeding port is disposed on the upper surface of the apparatus main body at a position further toward the front of the apparatus main body than the paper discharging tray.

4. The image forming apparatus according to claim 1 further comprising:

a lid, which can be opened and closed, and which covers the manual paper feeding port when closed, wherein when the lid is opened, the recording medium inserted into the manual paper feeding port is supported by the lid, and the recording medium is kept in an inclined state above the inclined path.

5. The image forming apparatus according to claim 4, wherein when the lid is opened, the lid prevents the recording medium, which has reached a certain position on the lid, from being pushed further toward the front side of the apparatus main body.

6. The image forming apparatus according to claim 1 further comprising:

a discharging path along which the recording medium is conveyed after the image is formed on the recording medium by the image forming unit;

a paper discharging tray which is disposed above the cartridge attached to the apparatus main body and is configured to receive the recording medium discharged through the discharging path thereon, wherein the front cover includes a lid which is configured to be opened and closed and which covers the manual paper feeding port when closed, wherein when the lid is opened, the recording medium inserted into the manual paper feeding port is supported by the lid, and the recording medium is kept in an inclined state above the inclined path, and wherein the lid prevents the recording medium which is discharged from the discharging path and has reached a certain position being pushed further toward the front side of the apparatus body so that the recording medium is placed on the paper discharging tray.

7. The image forming apparatus according to claim 1, wherein the front cover includes a lid which is configured to be opened and closed and which covers the manual paper feeding port when closed, when the lid is opened, the recording medium inserted into the manual paper feeding port is supported by the lid, and the recording medium is kept in an inclined state above the inclined path, and when the lid is opened, an entirety of the lid overlaps with the apparatus main body when the image forming apparatus is viewed in a plan view.

8. An image forming apparatus comprising:

an apparatus main body;

an image forming unit configured to form an image on a recording medium;

a first conveying path, along which a recording medium accommodated in a paper feeding cassette is conveyed to the image forming unit from the paper feeding cassette;

a second conveying path, along which a recording medium inserted into a manual paper feeding port is conveyed to the image forming unit from the manual paper feeding port; and a front cover disposed on a front surface of the apparatus main body and including a free end edge and a base end edge disposed opposite to the free end edge, the front cover being configured to be rotated around the base end edge to be opened and closed with respect to the apparatus main body, wherein a cartridge into which at least a part of the image forming unit is incorporated can be detachably attachable to the apparatus main body when the front cover is opened, and wherein the manual paper feeding port is formed at a front side of the image forming apparatus on an upper surface of the apparatus main body and disposed above the cartridge attached to the apparatus main body, wherein an inclined path obliquely extending from the manual paper feeding port to below and toward a rear of the apparatus main body is formed, wherein a first guide portion and a second guide portion are disposed inside the apparatus main body, a clearance formed between the first guide portion and the second guide portion forms the inclined path, and when the cartridge is loaded on the apparatus main body, an outer surface part of the cartridge forms the first guide portion, and when the front cover is closed, an inner surface part of the front cover forms the second guide portion, the manual paper feeding port is disposed between a paper discharging tray on which the recording medium is discharged, and the free end edge of the closed front cover.

9. An image forming apparatus comprising:

an image forming unit configured to form an image on a recording medium;

a first conveying path, along which a recording medium accommodated in a paper feeding cassette is conveyed to the image forming unit from the paper feeding cassette;

a second conveying path, along which a recording medium inserted into a manual paper feeding port is conveyed to the image forming unit from the manual paper feeding port; and a front cover disposed on a front surface of the apparatus main body and including a free end edge and a base end edge disposed opposite to the free end edge, the front cover being configured to be rotated around the base end edge to be opened and closed with respect to the apparatus main body, wherein a cartridge into which at least a part of the image forming unit is incorporated can be detachably attachable to the apparatus main body when the front cover is opened, and the front cover includes a lid configured to be opened and closed and cover the manual paper feeding port, wherein the manual paper feeding port is formed at a front side of the image forming apparatus on an upper surface of the apparatus main body and disposed above the cartridge attached to the apparatus main body, wherein an inclined path obliquely extending from the manual paper feeding port to below and toward a rear of the apparatus main body is formed, wherein a first guide portion and a second guide portion are disposed inside the apparatus main body, a clearance formed between the first guide portion and the second guide portion forms the inclined path, when the cartridge is loaded on the apparatus main body, an outer surface part of the cartridge forms the first guide portion, and when the front cover is closed, an inner surface part of the front cover forms the second guide portion, and the opened lid, and the free end edge of the closed front cover and the second guide portion are flush with each other.

* * * * *